US006262643B1

(12) United States Patent
Lassalle

(10) Patent No.: US 6,262,643 B1
(45) Date of Patent: Jul. 17, 2001

(54) MECHANISM FOR CONTROLLING AN ELECTRICAL CIRCUIT BREAKER

(75) Inventor: Jean-Paul Lassalle, Chaneins (FR)

(73) Assignee: Entrelec S.A., Villeurbanne (FR)

( * ) Notice: Subject to any disclaimer, the term of this patent is extended or adjusted under 35 U.S.C. 154(b) by 0 days.

(21) Appl. No.: 09/646,571

(22) PCT Filed: Jan. 31, 2000

(86) PCT No.: PCT/FR00/00217

§ 371 Date: Nov. 27, 2000

§ 102(e) Date: Nov. 27, 2000

(87) PCT Pub. No.: WO00/45408

PCT Pub. Date: Aug. 3, 2000

(30) Foreign Application Priority Data

Feb. 1, 1999 (FR) ..... 99 01261

(51) Int. Cl.[7] ..... H01H 73/02; H01H 75/00; H01H 77/00; H01H 83/00

(52) U.S. Cl. ..... 335/21; 335/6; 335/172

(58) Field of Search ..... 335/6, 21, 26, 335/27, 167–176

(56) References Cited

U.S. PATENT DOCUMENTS

Re. 33,400 * 10/1990 Fujii et al. ..... 335/26
4,968,863 * 11/1990 Rezac et al. ..... 200/401
5,162,765 * 11/1992 DiVincenzo et al ..... 335/175

FOREIGN PATENT DOCUMENTS

2552930 * 4/1985 (FR) .

* cited by examiner

*Primary Examiner*—Ramon M. Barrera
(74) *Attorney, Agent, or Firm*—Oliff & Berridge, PLC

(57) ABSTRACT

This mechanism comprises a fixed contact (3), a mobile contact (4) mounted in a support (5) pivoting on the casing (2), an operating knob (13) actuating a pivoting pawl (16) via a link rod (15), forming a toggle lever system, and a trip element (25) which can be actuated by electromagnetic and/or thermal circuit-breaking means.

The pawl is mounted so that it can pivot on the support for the mobile contact about an axle located near the end of this support which is the opposite end to the end equipped with the mobile contact part intended to rest against the fixed contact, and the trip element consists of a part in the overall shape of an L, one of the branches of which is intended to be actuated by the circuit-breaking mechanism and the other branch of which is equipped with a ramp, of which the surface facing the outside of the L is intended to rest under a complementary ramp, that the pawl has, to keep the toggle lever system and thus the support for the mobile contact in a position in which the contacts are closed.

15 Claims, 4 Drawing Sheets

MECHANISM FOR CONTROLLING AN ELECTRICAL CIRCUIT BREAKER

The subject of the present invention is a mechanism for operating an electric circuit breaker.

An electric circuit breaker is aimed at protecting an electrical installation by opening an electric circuit when a fault is detected, when there is overload or a rise in temperature, this opening of the circuit being achieved via an electromagnetic trip and/or a thermal trip, depending on the type of fault observed. In general, circuit breakers react firstly to an electromagnetic trip and, secondly, to a thermal trip.

The circuit breaker concerned here, is of the type comprising an insulating casing inside which are mounted:

- a contact mounted fixedly in the casing,
- a contact mounted in a support, pivoting in the casing between a closed position and an open position in which the two contacts are apart,
- a pivoting manual operating knob, mounted articulated on the casing, and to which is articulated one end of a link rod, the other end of which is mounted, with the possibility of pivoting, on a pivoting pawl, so as to form a toggle lever system collaborating with the support for the mobile contact so as to close or not close the contacts, according to the position of the toggle lever system,
- elastic means for, on the one hand, closing the contacts and, on the other hand, opening them, according to the position of the toggle lever system,
- a trip element mounted so that it can pivot on the casing and subjected to the action of elastic return means returning it to a basic position from which it can be moved away by electromagnetic and/or thermal circuit-breaking means, so as to actuate the toggle lever system in a direction for opening the contacts.

The object of the invention is to provide a circuit breaker of this type, the control mechanism of which is of a simple structure, reacts very quickly, has good reliability, including if the contacts are slightly welded together as a result of heating, and which has excellent safety properties, in particular not being resettable as long as the thermal trip is in the detection position, or not allowing the circuit breaker to be held manually in a semi-closed position by manually holding the operating knob in an intermediate position.

To this end, in the control mechanism to which it relates:

- the pawl is mounted so that it can pivot on the support for the mobile contact about an axle located near the end of this support which is the opposite end to the end equipped with the mobile contact part intended to rest against the fixed contact, and
- the trip element consists of a part in the overall shape of a L, one of the branches of which is intended to be actuated by the circuit-breaking means, and the other branch of which is equipped with a ramp, of which the surface facing the outside of the L is intended to rest under a complementary ramp, that the pawl has, to keep the toggle lever system and thus the support for the mobile contact in a position in which the contacts are closed.

When the circuit breaker is in the closed position, the toggle lever system is in a certain position. When the trip element is actuated by a circuit-breaking means, the ramp of the trip element lifts the ramp of the pawl, causing the latter to pivot to "break" the toggle lever system and cause it to move into its position corresponding to the circuit breaker being open. As soon as the toggle lever system has moved past its neutral point, the mobile contact pivots into the open position under the action of a spring.

Advantageously, the support for the mobile contact has the shape of a stirrup piece, that is to say comprises a central cavity in which the mobile contact is engaged, the end of the contact which is the opposite end to the end intended to rest against the fixed contact, being rounded so as to pivot in the, also rounded, bottom of the central cavity, the contact having, on its surface facing the fixed contact, a cut-out for the passage of the axle that articulates its support to the casing and a nose which, located between the axle of rotation of the support on the casing and the axle articulating the pawl to the support, serves for attaching a tension spring, the other end of which is fixed to the casing on the same side as the fixed contact with respect to the support for the mobile contact.

It must be noted that as the spring acts on the mobile contact and as the mobile contact is itself mounted with play inside its support, a slight shear movement of the mobile contact with respect to the fixed contact occurs upon the command to open the circuit breaker, making the opening conditions easier, especially if, under the action of previous heating, the two contacts have become slightly welded together. Furthermore, the location of the spring associated with the mobile contact allows this spring to act both in a direction for closing the contacts and also in a direction for opening the circuit breaker as soon as the toggle lever system has been "broken" and as soon as the support for the mobile contact can pivot.

According to another feature of the invention, the link between the link rod and the pawl is achieved by a curved end of the link rod engaged in a cavity in the pawl, this cavity being open on the side opposite the support for the mobile contact and comprising, towards the front and towards the rear, noses to allow the pawl to be actuated by the link rod in the direction for opening and in the direction for closing.

Under these conditions, as soon as the knob has been pivoted past the neutral point of the toggle lever system, the circuit breaker automatically switches to the tripped position under the action of the tension spring. This opening occurs even if the knob is not actuated towards its fully open position. This is a safety feature insofar as the circuit breaker can occupy just two stable positions, without the risk of an operator holding the knob in a semi-open position in which the mobile contact would be near to the fixed contact, as this would very soon lead to overheating and damage of the circuit breaker.

According to another feature of the invention, the pawl has, on one of its surfaces, a lug or the like, intended to rest against a post formed in the corresponding wall of the casing, to guide the pivoting of the pawl on the support for the mobile contact, when the circuit breaker is actuated.

Advantageously, the second branch of the trip element is placed between an electromagnetic circuit-breaker coil and a thermal trip, of the bimetallic strip type, and comprises a finger used for direct actuation, by pushing, and a nose allowing actuation by pulling, using a slide secured to the thermal trip.

As a preference, in this case, the slide associated with the thermal trip has an arm which, when the circuit breaker is in the tripped position and the bimetallic strip system is deformed under the action of heat, lifts the link rod and prevents it from being coupled to the pawl. In this case, the link rod is kept raised by the arm of the slide, and cannot therefore enter the cavity in the pawl to allow coupling therewith.

In any event, the invention will be well understood from the description which follows, with reference to the appended diagrammatic drawing which, by way of nonlimiting example, depicts one embodiment of this mechanism:

Figure 1:
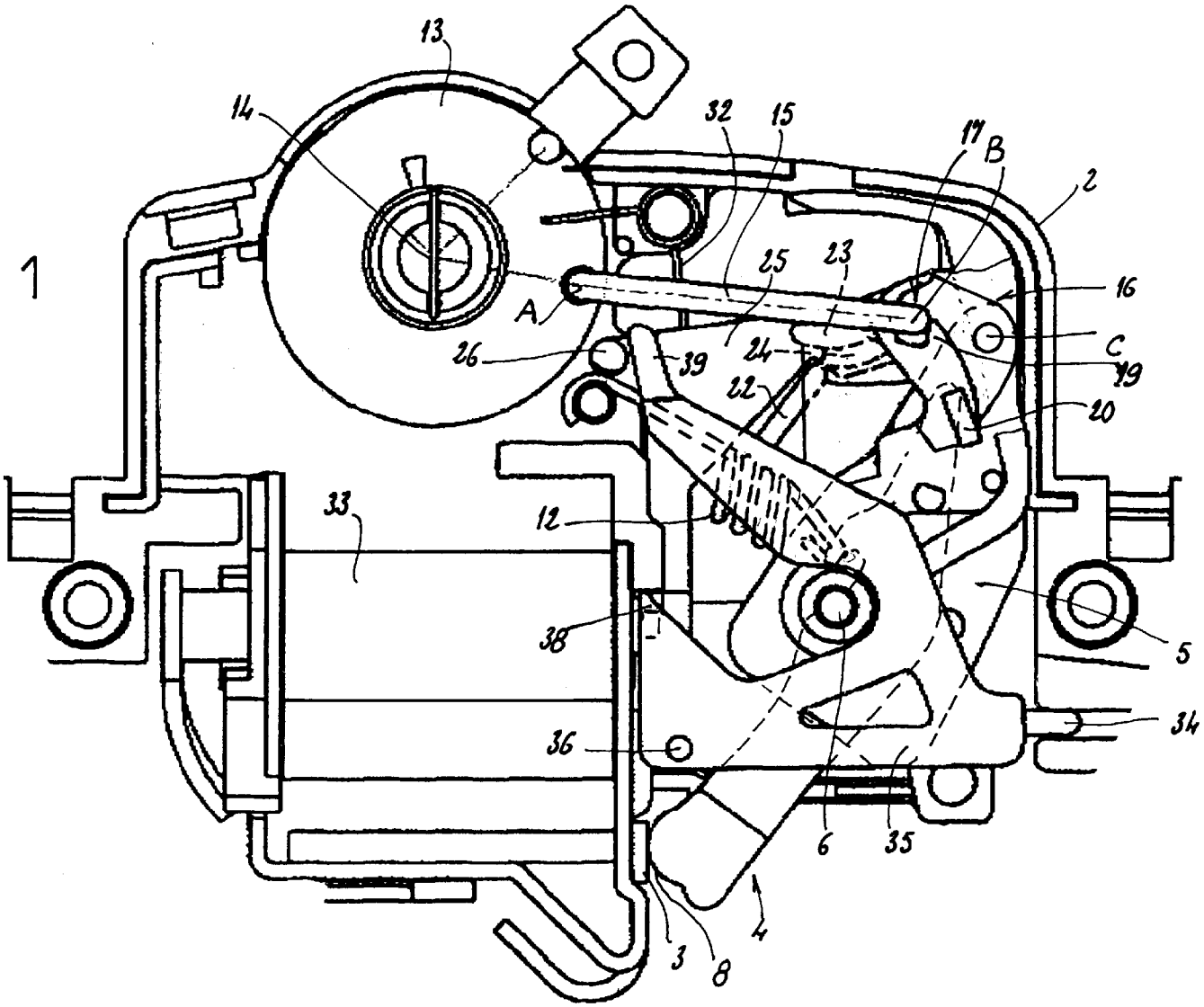
FIGS. 1 and 2 are two elevations thereof, in the closed position and in the open position, respectively.

The circuit breaker depicted in the drawing comprises an insulating casing 2 inside which are mounted a fixed contact 3 and a mobile contact 4. The fixed contact 3 is secured to the casing and the mobile contact 4 can move to come into contact with the fixed contact 3, as shown in FIG. 1, and close the electric circuit or, on the contrary, be moved away from the fixed contact 3 to open the circuit. The mobile contact 4 is mounted inside a support 5 which pivots about an axle 6 on the casing. The support 5 has a cavity, the bottom of which is rounded and allows a small amount of pivoting of the rounded end 7 of the mobile contact 4, this end 7 being the opposite end to the end 8 intended to come into contact with the fixed contact 3. The mobile contact 4 comprises, on its surface facing the fixed contact, a cut-out 9 allowing the passage of the axle 6 of pivoting of the support 5. Between the cut-out 9 and the rounded end 7, the mobile contact 4 has, on one and the same side, a nose 10 serving for the attachment of a tension spring 12, the other end of which is fixed to the casing, on the same side as the fixed contact 3, with respect to the support 5 for the mobile contact. The circuit breaker also comprises an operating knob 13 mounted so that it can pivot on the casing about an axle 14. Articulated to this pivoting knob, about an axle A, is one end of a link rod 15, the other end B of which is mounted, with the possibility of pivoting, on a pawl 16, this pawl 16 being articulated to the support 5 for the mobile contact about an axle C on that side of the support 5 which is on the other side from the pivot axle 6, with respect to that end 8 of the contact that is intended to rest against the fixed contact 3.

Figure 6:
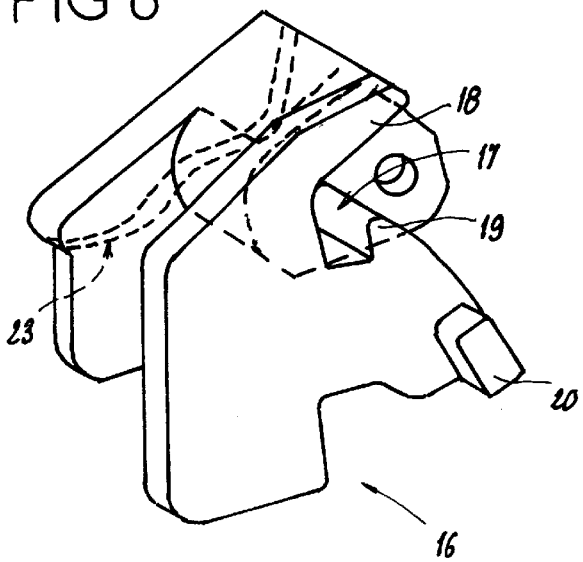
FIG. 6 is a perspective view of the pawl.
Figure 7:
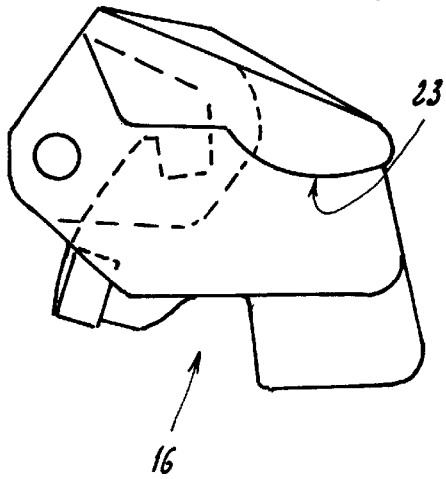
FIG. 7 is a side view of this pawl.

The pawl 16, which is shown in greater detail in FIGS. 6 and 7, comprises a cavity 17 in which the curved end of the link rod 15 forming the axle B is intended to be engaged. This cavity 17 is open on the side opposite the support for the mobile contact and, towards the front and towards the rear has noses 18, 19 allowing the pawl to be actuated by the link rod in the direction for opening and in the direction for closing. The pawl has, on one of its surfaces, a lug 20 intended to rest against a post 22 formed in the corresponding wall of the casing, to guide the pivoting of the pawl on the support for the mobile contact when the circuit breaker is actuated. The pawl finally has a ramp 23 which, when the circuit breaker is in the closed position, as shown in FIG. 1, faces downwards, and is located alongside the link rod 15, this ramp being intended to rest against a ramp 24 of a trip element 25.

This trip element 25, articulated to the casing about an axle 26, has the overall shape of an L, having a first branch 27 which bears the ramp 24 and a second branch 28 which extends towards the fixed contact 3 and has a finger 29 and a nose 30. The trip element is normally kept in a normal position by a return spring 32. In this position, the branch 28 of the element rests against the core plunger of an electromagnetic trip coil 33, and this core plunger rests against the finger 29. Deployment of this core plunger, by pressing directly on the finger 29, causes the trip 25 to pivot in the anticlockwise direction. On the other side of the branch 28 there is a bimetallic strip system 34 acting on a slide 35 guided by fingers 36 in slots 37 in the casing. This slide has a nose 38 intended to catch behind the nose 30 of the branch 28 of the trip element 25 to cause the trip element to pivot when the slide moves under the action of heating of the bimetallic strip system. The slide 35 also has an arm 39 intended, when the slide is in the retreated position under the action of the deformation of the bimetallic strip system, to lift the link rod 15 by pressing against its end, so as to prevent this link rod from being able to engage in the cavity 17 in the pawl.

Figure 2:
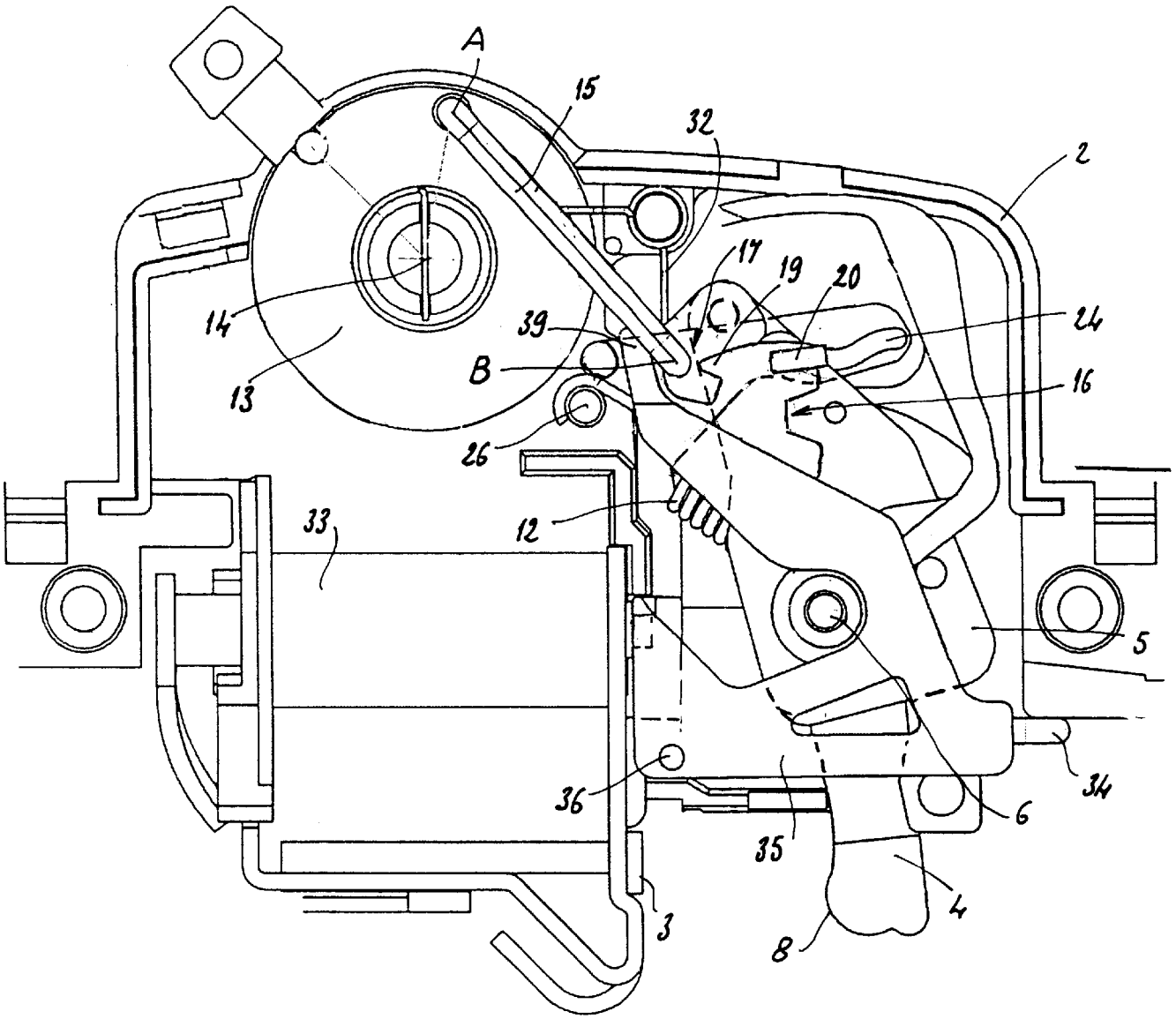
Figure 3:
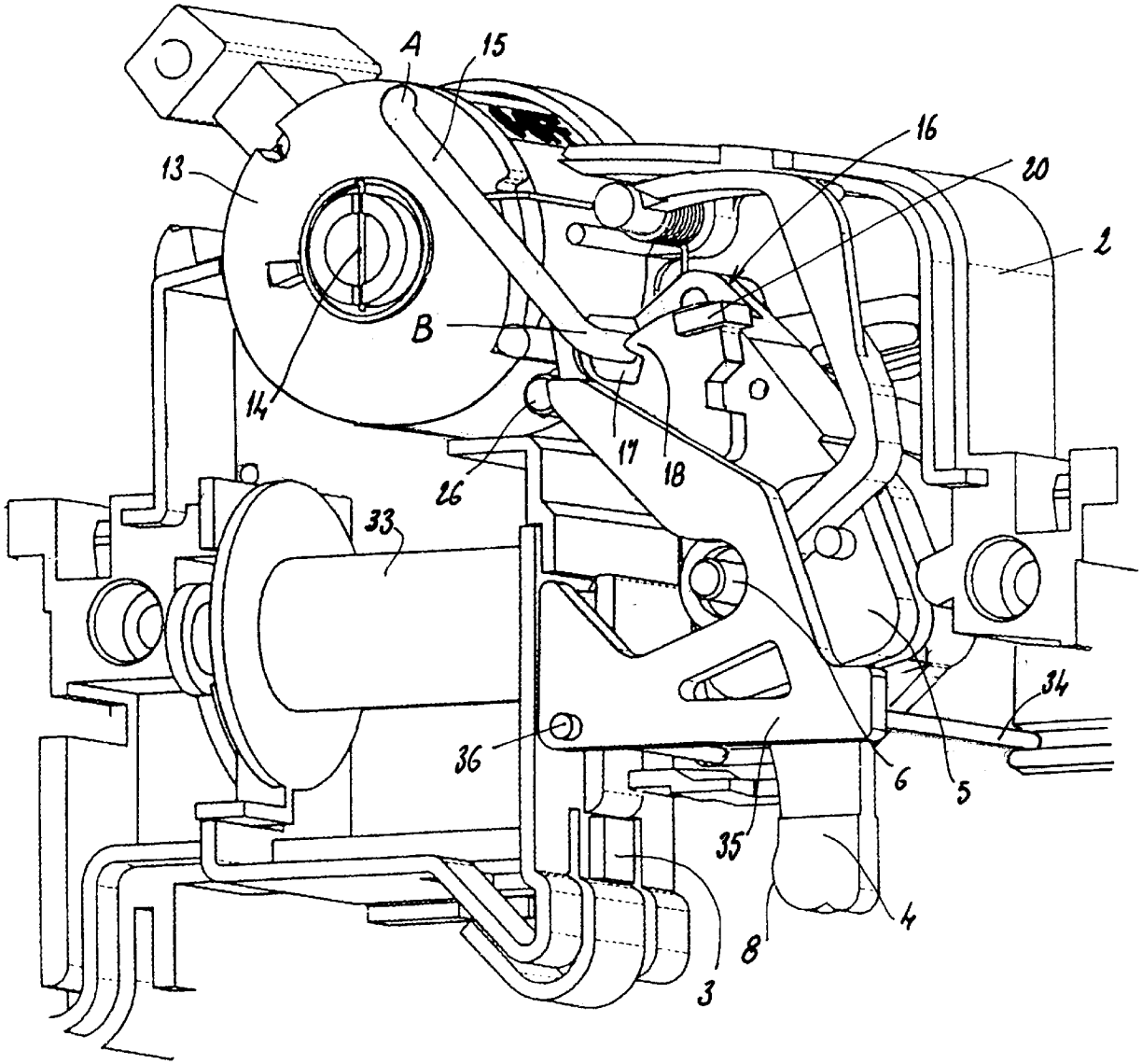
FIG. 3 is a perspective view thereof in the open position.
Figure 4:
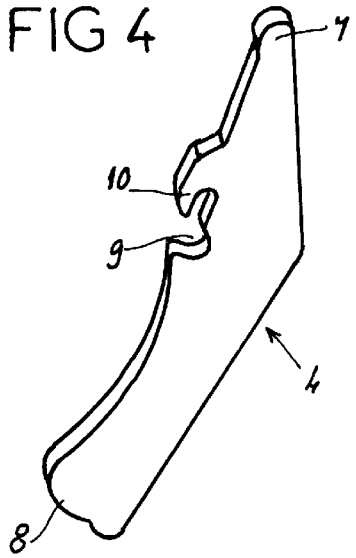
FIG. 4 is a perspective view of the mobile contact.
Figure 5:
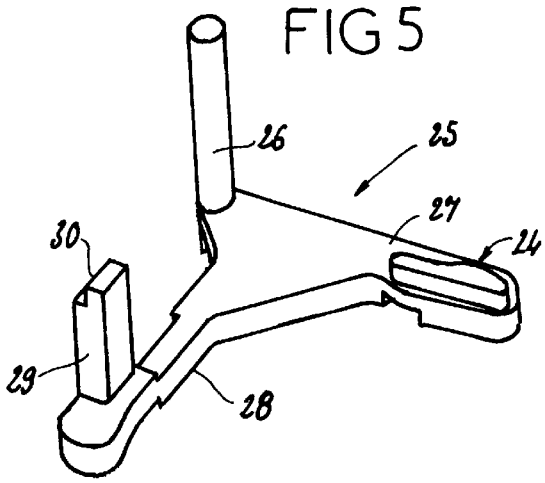
FIG. 5 is a perspective view of the trip element.

This circuit breaker operates as follows:

with the circuit breaker in the closed position depicted in FIG. 1, it is possible to open it, deliberately, by actuating the operating knob in the anticlockwise direction. It may be seen that, when the circuit breaker is in the closed position, the link rod 15 and the pawl form, at points A, B, C, a toggle lever system, points A, B, C delimiting a triangle, point B being on one side of the line A-C. The ramp 23 of the pawl is resting against the ramp 24 of the trip. When the knob is actuated and the contact is stuck, the end of the link rod 15 rests against the nose 18 delimiting the recess 17 of the pawl, and causes a pivoting of the pawl accompanied by a modification of the position of the points A, B, C, which results in disruption of the previous equilibrium of the toggle lever system. The pawl 16, pivoting on the support 5 of the mobile contact, frees the latter so that the tension spring 12 acts on the said support, via the mobile contact 4, to cause the assembly consisting of support 5 and contact 4 to pivot into the open position depicted in FIG. 2. It may be noted that if the operator does not turn the knob 13 all the way, the circuit breaker will open nonetheless, insofar as, having moved through the neutral point of the toggle lever system, the pawl 16 and the support 5 continue their movement insofar as the curved end of the link rod can uncouple itself from the pawl by escaping from the recess 17.

In another scenario, the circuit breaker can open under the action of an electromagnetic circuit breaker, by deployment of the core plunger of the coil 33. The coil rests against the finger 29 of the branch 28 of the trip 25, causing the trip element 25 to pivot in the anticlockwise direction, the ramp 24 of the trip lifting the ramp 25 of the pawl, thus "breaking" the toggle lever system, freeing the support 5 of the mobile contact which pivots in the direction for opening the circuit breaker under the action of the spring 12.

The circuit breaker can also open under the action of the thermal bimetallic strip system 34. Deformation of the bimetallic strip system 34 results in a movement to the right of the slide 35, the nose 38 of which exerts a tension on the nose 30 of the trip element 25, causing the latter to pivot in the anticlockwise direction, and consequently opening the circuit breaker in the way mentioned earlier.

The circuit breaker is closed by pivoting the knob 13 in the clockwise direction, during which movement the curved end of the link rod 15 pushes the pawl by pressing against the nose 19 of the recess 17, the pawl being guided in rotation by the lug 20 which is guided on the post 22 of the casing in order to achieve the desired pivoting. During this movement, the pawl causes the support 5 and the mobile contact 4 to rotate in a direction of closing the circuit breaker, the end of the travel of the knob 13 corresponding to the position of the toggle lever system in which the points A, B, C occupy the stable position depicted in FIG. 1.

As is apparent from the foregoing, the invention provides a great improvement to the state of the art, by providing an electric circuit breaker of simple structure, dependable and reliable operation, and offering very safe use.

As goes without saying, the invention is not restricted to the single embodiment of this circuit breaker which has been described hereinabove by way of example; on the contrary, it encompasses all alternative forms thereof. Hence, in particular, the mobile contact could be mounted without play inside the pivoting support, without in any way departing from the scope of the invention.

What is claimed is:

1. Mechanism for operating an electric circuit breaker, of the type comprising an insulating casing (2) inside which are mounted:

a fixed contact (3) mounted fixedly in the casing, a mobile contact (4) mounted in a support (5), pivoting in the casing between a closed position and an open position in which the two contacts are apart, a pivoting manual operating knob (13), mounted articulated on the casing, and to which is articulated one end of a link rod (15), the other end of which is mounted, with the possibility of pivoting, on a pivoting pawl (16), so as to form a toggle lever system collaborating with the support (5) for the mobile contact (4) so as to close or not close the contacts, according to the position of the toggle lever system, elastic means (12) for, on the one hand, closing the contacts (3, 4) and, on the other hand, opening them, according to the position of the toggle lever system, a trip element (25) mounted so that it can pivot on the casing and subjected to the action of elastic return means (32) returning it to a basic position from which it can be moved away by electromagnetic (33) and/or thermal (34) circuit-breaking means, so as to actuate the toggle lever system in a direction for opening the contacts, characterized in that the pawl (16) is mounted so that it can pivot on the support (5) of the mobile contact (4) about an axle (6) located near the end of this support which is the opposite end to the end equipped with the mobile contact part intended to rest against the fixed contact, and the trip element (25) consists of a part in the overall shape of a L, one (28) of the branches of which is intended to be actuated by the circuit-breaking means (33, 34), and the other branch (27) of which is equipped with a ramp (24), of which the surface facing the outside of the L is intended to rest under a complementary ramp (23), that the pawl (16) has, to keep the toggle lever system and thus the support (5) of the mobile contact in a position in which the contacts are closed.

2. Mechanism according to claim 1, characterized in that the support (5) for the mobile contact has the shape of a stirrup piece, that comprises a central cavity in which the mobile contact (4) is engaged, the end (7) of the contact which is the opposite end to the end (18) intended to rest against the fixed contact (3), being rounded so as to pivot in the, also rounded, bottom of the central cavity, the contact (4) having, on its surface facing the fixed contact, a cut-out (9) for the passage of the axle (6) that articulates its support (15) to the casing (2), and a nose (10) which, located between the axle (6) of rotation of the support (5) on the casing (2) and an axle (c) articulating the pawl (16) to the support (5), serves for attaching said elastic means which is a tension spring (12), the other end of which is fixed to the casing (2) on the same side as the fixed contact (3) with respect to the support (5) for the mobile contact.

3. Mechanism according to claim 2, characterized in that the link between the link rod (15) and the pawl (16) is achieved by a curved end of the link rod engaged in a cavity (17) in the pawl, this cavity being open on the side opposite the support (5) for the mobile contact and comprising, towards the front and towards the rear, noses (18, 19) to allow the pawl (16) to be actuated by the link rod (15) in the direction for opening and in the direction for closing.

4. Mechanism according the claim 2, characterized in that the pawl (16) has, on one of its surfaces, a lug (20) intended to rest against a post (22) formed in the corresponding wall of the casing, to guide the pivoting of the pawl (16) on the support for the mobile contact, when the circuit breaker is actuated.

5. Mechanism according to claim 2, characterized in that the second branch (28) of the trip element (25) is placed between an electromagnetic circuit-breaker coil (3) and a thermal trip (34), of the bimetallic strip type, and comprises a finger (29) used for direct actuation, by pushing, and a nose (30) allowing actuation by pulling, using a slide (35) secured to the thermal trip.

6. Mechanism according to claim 5, characterized in that the slide (35) associated with the thermal trip (34) has an arm (39) which, when the circuit breaker is in the tripped position and the bimetallic strip system (34) is deformed under the action of heat, lifts the link rod (15) and prevents it from being coupled to the pawl.

7. Mechanism according to claim 1, characterized in that the link between the link rod (15) and the pawl (16) is achieved by a curved end of the link rod engaged in a cavity (17) in the pawl, this cavity being open on the side opposite the support (5) for the mobile contact and comprising, towards the front and towards the rear, noses (18, 19) to allow the pawl (16) to be actuated by the link rod (15) in the direction for opening and in the direction for closing.

8. Mechanism according the claim 7, characterized in that the pawl (16) has, on one of its surfaces, a lug (20) intended to rest against a post (22) formed in the corresponding wall of the casing, to guide the pivoting of the pawl (16) on the support for the mobile contact, when the circuit breaker is actuated.

9. Mechanism according to claim 7, characterized in that the second branch (28) of the trip element (25) is placed between an electromagnetic circuit-breaker coil (3) and a thermal trip (34), of the bimetallic strip type, and comprises a finger (29) used for direct actuation, by pushing, and a nose (30) allowing actuation by pulling, using a slide (35) secured to the thermal trip.

10. Mechanism according to claim 9, characterized in that the slide (35) associated with the thermal trip (34) has an arm (39) which, when the circuit breaker is in the tripped position and the bimetallic strip system (34) is deformed under the action of heat, lifts the link rod (15) and prevents it from being coupled to the pawl.

11. Mechanism according to claim 1, characterized in that the pawl (16) has, on one of its surfaces, a lug (20) intended to rest against a post (22) formed in the corresponding wall of the casing, to guide the pivoting of the pawl (16) on the support for the mobile contact, when the circuit breaker is actuated.

12. Mechanism according to claim 11, characterized in that the second branch (28) of the trip element (25) is placed between an electromagnetic circuit-breaker coil (3) and a thermal trip (34), of the bimetallic strip type, and comprises a finger (29) used for direct actuation, by pushing, and a nose (30) allowing actuation by pulling, using a slide (35) secured to the thermal trip.

13. Mechanism according to claim 12, characterized in that the slide (35) associated with the thermal trip (34) has an arm (39) which, when the circuit breaker is in the tripped position and the bimetallic strip system (34) is deformed under the action of heat, lifts the link rod (15) and prevents it from being coupled to the pawl.

14. Mechanism according to claim 1, characterized in that the second branch (28) of the trip element (25) is placed between an electromagnetic circuit-breaker coil (3) and a thermal trip (34), of the bimetallic strip type, and comprises a finger (29) used for direct actuation, by pushing, and a nose (30) allowing actuation by pulling, using a slide (35) secured to the thermal trip.

15. Mechanism according to claim 14, characterized in that the slide (35) associated with the thermal trip (34) has an arm (39) which, when the circuit breaker is in the tripped position and the bimetallic strip system (34) is deformed under the action of heat, lifts the link rod (15) and prevents it from being coupled to the pawl.

* * * * *